United States Patent [19]

Gillette

[11] Patent Number: 4,642,063

[45] Date of Patent: Feb. 10, 1987

[54] SPACE TOY CONSTRUCTION KIT

[76] Inventor: Douglas Gillette, 6321 N. Washtenaw St., #3, Chicago, Ill. 60659

[21] Appl. No.: 524,997

[22] Filed: Aug. 22, 1983

[51] Int. Cl.[4] ..... A63H 17/00

[52] U.S. Cl. ..... 446/94

[58] Field of Search ..... 446/93, 94, 95, 96, 446/88, 85, 107, 121, 120, 126, 125, 124, 128, 89, 230, 231; D21/87

[56] References Cited

U.S. PATENT DOCUMENTS

| | | | |
|---|---|---|---|
| D. 194,444 | 1/1963 | Kramer et al. | 446/231 X |
| 2,609,638 | 9/1952 | Lindenmeyer | 446/85 X |
| 3,126,667 | 3/1964 | Rabionow | 46/17 |
| 3,224,137 | 12/1965 | Wright et al. | 46/26 |
| 3,754,349 | 8/1973 | Wallace | 46/17 |
| 4,144,669 | 3/1979 | Ogawa | 46/17 |
| 4,167,830 | 9/1979 | Ogawa | 46/17 |
| 4,170,839 | 10/1979 | O'Donnell | 446/89 |
| 4,193,597 | 3/1980 | Ogawa | 273/405 |
| 4,214,402 | 7/1980 | Ogawa | 46/17 |
| 4,294,032 | 10/1981 | Breneman | 446/231 |

OTHER PUBLICATIONS

"Cosmic Clipper," by U.S. Airfix, Inc. of Hewitt, Tex., ©1980.

"Micronauts Betatron," by Mego Corporation, N.Y., N.Y., ©1978.

"Zoids," by Tomy Corporation, Carson, Calif., copyright and publication not known.

"Construx," by Fisher-Price Toys.

"Alpha Probe," by Fisher-Price Toys, E. Aurora, N.Y.

*Primary Examiner*—Mickey Yu

*Attorney, Agent, or Firm*—Marvin N. Benn; Milton S. Gerstein

[57] ABSTRACT

A knockdown toy having a number of component series, that, when assembled, are designed to resemble and simulate a space station or space ship. Each component series includes a number of identically-shaped parts that are interconnectable and repositionable to resemble a space ship or station. Seven major component series are included, each of which is designed to resemble, when constructed together, different operating and basic parts of a space station or space ship, whether real or imagined. Supplementary component series are also provided to simulate other parts of a space station or space ship such as engines, antennae, fuel tanks, landing pods, solar panels, and heat radiators. These supplementary component parts are connectable to some of the major component parts either directly or by means of tie pins. The major component series, when assembled, define the backbone and infrastructure of a space ship or space station replica, while the supplementary components add simulated functional elements to the design.

7 Claims, 36 Drawing Figures

SPACE TOY CONSTRUCTION KIT

BACKGROUND OF THE INVENTION

The present invention is directed to a knockdown toy that includes a number of different components capable of being assembled into a variety of shapes, sizes, and designs, all of which, according to the main theme of the present invention, simulate a space station or space ship.

The National Aeronautics and Space Administration (NASA) is currently developing plans for the design, manufacture and launching of a space station which is to orbit the earth, and upon which a number of men and women will live, work and sleep. The current state of such a space station is so advanced that it is hoped that such a space station will be built and launched during this decade.

The space station envisioned and designed by the NASA engineers and scientists will, of course, have to include a large main section in which the inhabitants live and work and sleep, and must also include a number of support systems, such as fuel and oxygen storage tanks, solar collecting panels, antennae, a command module where the controls are situated, and many more components necessary for the successful launching and maintenance of the space station in orbit. Support structure for all of these is also needed. NASA has already designed the type of space station to be placed in orbit, which space station will include all of the necessary parts mentioned above.

The present invention is a knockdown toy having a number of different parts which may be assembled into a finished sculpture or design which resembles the NASA space station design or one's own imagined design. Knockdown toys are well-known, and are known to have an end design such as a plane, an automobile, a boat, and many other designs. All of the toy components of such prior art knockdown toys are specially designed for the type of design the toy is to resemble when assembled.

SUMMARY OF THE INVENTION

It is, therefore, the primary objective of the present invention to provide a knockdown toy that when assembled into various shapes and sizes will resemble a space station or space ship, and which will be able to closely approximate the shape and design of the NASA designed space station when assembled in one finished form or sculpture and resemble or simulate any other shape and designed space station or space ship imagined by the user of the toy of the present invention.

It is still another objective of the present invention to provide a knockdown space ship toy that is easily assembled into a finished design or sculpture with the component parts of the toy being readily attachable and detachable without undue effort.

It is still another objective of the present invention to provide a knockdown space station toy that includes a number of different component parts, with each component part serving a special function in terms of connection with other component parts and in terms of the representation that component part is to achieve in the finished design or sculpture.

It is still another objective of the present invention to provide a knockdown space station toy that may be assembled into an almost limitless number of different designs and sculptures, with the only limiting factor being the imagination of the user of the toy.

To the achievement of the above ends, the present invention has as first component parts a plurality of what are termed "engineering modules," which engineering module is typically a hollow cylindrical element having a female threaded connecting end and a male threaded connecting end for attachment of these engineering modules in a series, one after another, with each engineering module being connected to another one. When so assembled, the hollow interiors of the engineering modules represent the living and working space of an imagined space station or space ship. The number of these engineering modules so assembled is up to the desires of the user of the toy.

The second component parts are a plurality of what are termed "connecting tube components." Each connecting tube component attaches to a projection on an engineering module or may be interconnected to another connecting tube component via one of the third component parts of the invention which are termed "transition coupling members." Each transition coupling member joins one end of a connecting tube component to an end of another connecting tube component. The third components, the "transition coupling components," come in a variety of shapes so that the connecting tube components may be arranged in a linear array, at right angles to each other, at a 45 degree angle to each other, or be connected such that respective ends of four such connecting tube components are arranged adjacent each other so that each respective end of a connecting tube component is at right angles to two adjacent ends of connecting tube components, to thus form what is called an "X" junction. A "Y" junction is also provided.

The second component parts, the connecting tube components, preferably come in two different diametrical sizes that are cylindrical in shape. If one sized connecting tube component is to be joined to the differently sized connecting tube component, there are provided the "step-up transition elements," which connect ends of the two differently sized connecting tube components.

The fourth components of the present invention are a plurality of what are termed "command modules," which are spherical or spheroid hollow components meant to resemble or represent that area of a space station or space ship where the pilots and engineers control the operations and functions of the craft. Each command module includes two projecting female connecting pieces for reception of and attachment to one end of a connecting tube component.

The fifth components are a plurality of what are termed "rail components," where each rail component is an elongated and narrow straight member whose ends are insertable into holes. The connecting tube components and the engineering modules all have a plurality of holes formed in the outer circumference for reception of an end of a rail member by force fitting. These components are meant to represent the lattice support structure of an imagined space station.

The sixth components are a plurality of what are termed "rail connecting components." These sixth components tie together a plurality of rail components either in a straight line or at angles to each other, in any desired manner. These sixth components come in the same design as the third components, the transition coupling members, and thus have straight pieces, right angle pieces, 45 degree angle pieces, "X"-junction pieces and "Y"-junction pieces. Just as the third components allow for the connecting tube components to join a plurality of linear arrays of engineering modules together to form a continuous and solid-looking structure, so too do the sixth rail connecting components allow for joining of the rail components to any desired angular relationship to thus tie engineering modules or connecting tube components together, via the rail components.

There are also provided a number of supplementary component parts, such as antenna components, each having the shape of a dish antenna; tank components, each having the shape of a storage tank to simulate a fuel or oxygen storage tank; engine components, each having a funnel shaped member to resemble a rocket engine; landing pod components, each having a pod shape to resemble a landing pod, such as used on the lunar lander; and solar panel components, each having a rectangular shape or the like to resemble a solar panel of a space station which collects the sun's rays for power storage. These above-noted supplementary components are attachable to an engineering module or a connecting tube component either directly or by a plurality of tie studs or pins insertable at one end in a hole in an engineering module, or a hole in a connecting tube component, while the other end of the pin is insertable into a hole of a respective supplementary component.

The present invention also provides miniature space men attachable to an engineering module or a connecting tube component via a plurality of tether components, which are thin flexible wire-like components, where one end of each tether component is insertable into a hole of an engineering module or a conecting tube component, while the other end of the tether component is insertable into a hole formed in a miniature space man. Thus, simulated space walking may be achieved in the final design of the assembled toy. The space men may also be housed within the engineering modules and connecting tube components where they simulate men living and working in the space station, since, preferably, each engineering module and each connecting tube component is transparent.

The connection between engineering modules and connecting tube components are all, preferably, of the screw-threaded type, so that to connect any two pieces together, one merely need screw the two parts together, which allows for fast securing of the parts, yet allows easy separation and attachment.

Decals may also be provided for identifying the components by a name or a symbol. cl BRIEF DESCRIPTION OF THE DRAWINGS The invention will be more readily understood with reference to the accompanying drawing, wherein FIG. 1A is a perspective view showing one of the engineering modules which are the major first component series of the present invention;

FIG. 4A is a perspective view showing one of the linear transition coupling elements;

FIG. 4B is a perspective view showing one of the right-angle transition coupling elements;

FIG. 4C is a perspective view showing one of the 45-degree angle transition coupling elements;

FIG. 4D is a perspective view showing one of the "X" junction transition coupling elements;

FIG. 4E is a perspective view showing one of the "Y" junction transition coupling elements;

FIG. 10A is a perspective view showing one of the linear rail coupling elements;

FIG. 10B is a perspective view showing one of the right-angle rail coupling elements;

FIG. 10C is a pespective view showing one of the 45-degree-angle rail coupling elements;

FIG. 10D is a perspective view showing one of the "X" junction rail coupling elements;

FIG. 10E is a perspective view showing one of the "Y" junction rail coupling elements;

DETAILED DESCRIPTION OF THE INVENTION

Figure 17:
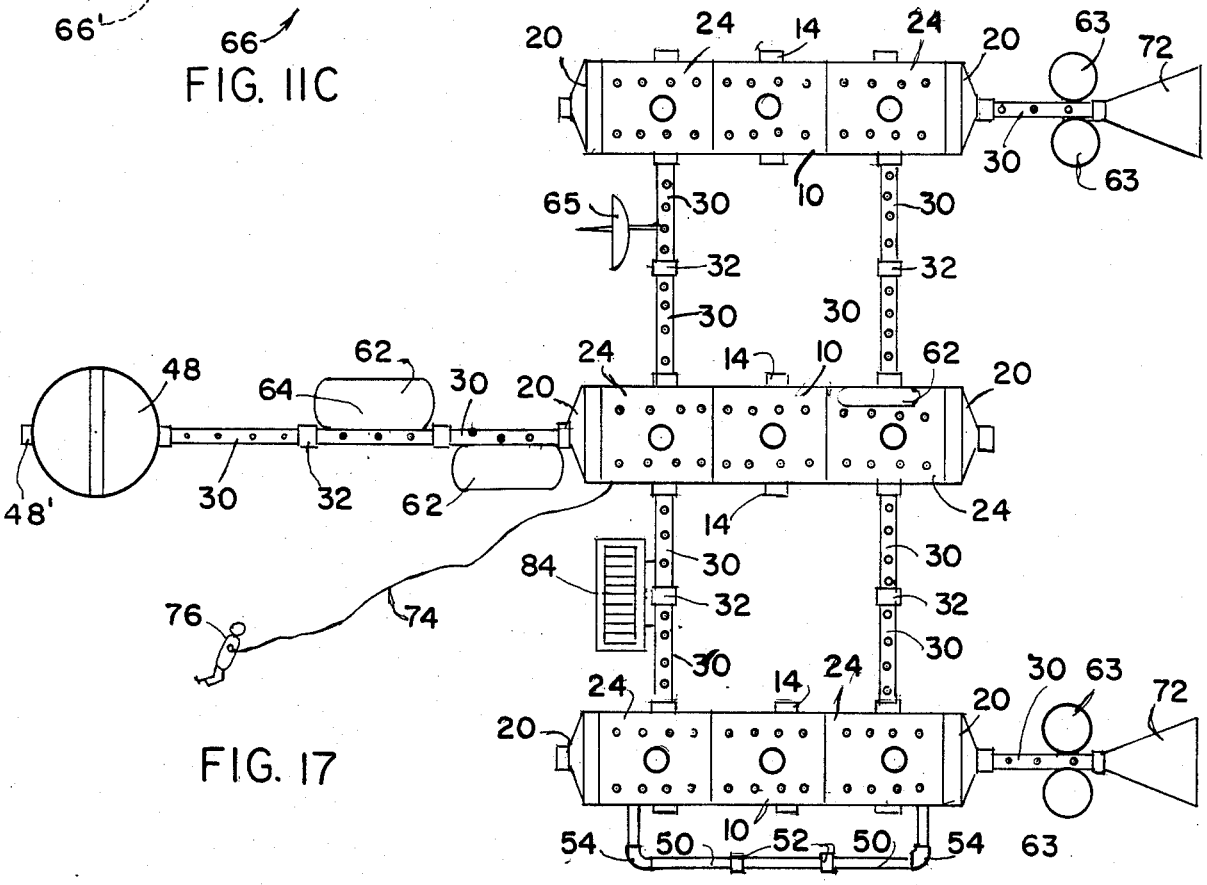
FIG. 17 is a plan view showing one of the many different designs possible utilizing the components of the present invention, which design simulates a space ship.
Figures 12A, 12B, 13, 14, 15, 16A, 16B, 18:
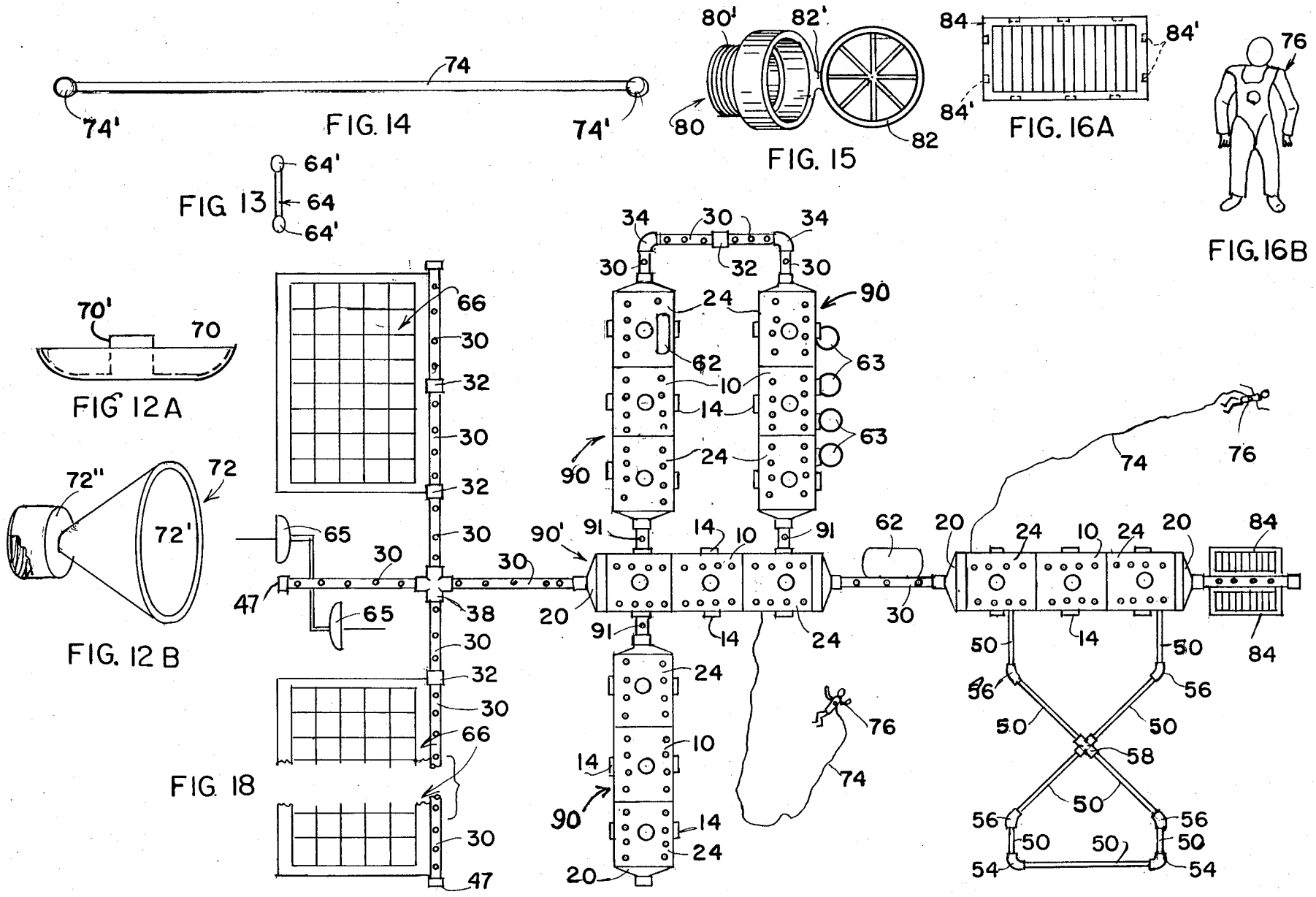
FIG. 12A is a side view showing one of the landing pod components also forming another part of the supplementary series.
FIG. 12B is a perspective view showing one of the engine components also forming another part of the supplementary component series.
FIG. 13 is a side view showing one of the tie studs constituting the tertiary component series of the present invention, which studs connect the tank storage components and the antenna components to the engineering modules and to the connecting tube components.
FIG. 14 is a plan view showing one of the tethers for insertion at one end in a hole and at the other end for connection to a space man.
FIG. 15 is a perspective view showing one of the air lock fittings for closing off the unattached radial tube fittings of the engineering modules.
FIG. 16A is a plan view showing one of the heat radiator elements constituting another portion of the supplementary components of the present invention for simulating a heat radiating element of a space station.
FIG. 16B is a plan view showing one of the miniature space men of the present invention.
FIG. 18 is a plan view showing another design assembled from the components of the present invention, which design simulates a space station.

Referring now to the drawing, where like reference numerals indicate like elements, FIGS. 1 through 16 show the separate component elements of the present invention that, when assembled together in any desired array, configuration and order, will depict a space ship or space station, as for example, shown, respectively, in FIGS. 17 and 18.

To first summarize all of the component elements before describing in detail the structure and interconnections thereof, it is noted that the present invention provides six major component series that constitute the backbone of the present invention in that the sculptures or designs are built up therefrom.

The present invention also provides a supplementary component series which include components having the shape of specific functional elements of a space craft or space ship, such as, for example, solar panels, heat radiators, antennae and the like, all of which are described below in greater detail.

The present invention also provides a tertiary component series used for connecting some of the other components of the major and supplementary components series together, which tertiary series includes a number of tie pins or studs, described in greater detail below. Each component series is herewith discussed.

First Component Series—Engineering Modules

Figure 1A:
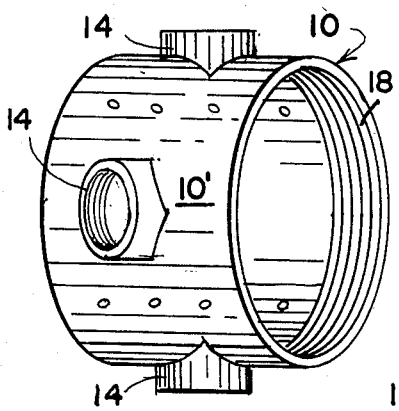
FIG. 1B is a side view of the engineering module of FIG. 1A.
FIG. 1C is a side view of a modified form of an engineering module used in the present invention to end a linear array of the engineering modules of FIG. 1A at an end of the array.
Figure 1B:
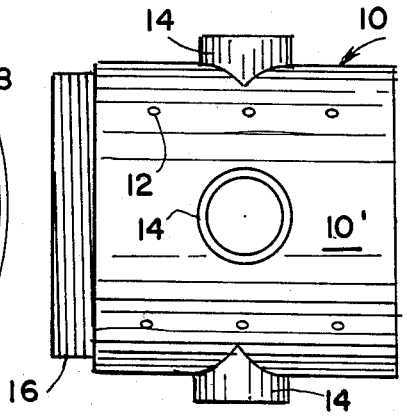

The first major component series of the present invention are what are termed the "Engineering Modules," and are shown in detail in FIGS. 1A and 1B. Each engineering module 10 is of a hollow cylindrical configuration having an annular surface 10′ in which are formed a plurality of holes 12. The holes 12 are preferably formed about the circumference of the annular surface 10′ in groups of three, spaced 90 degrees apart, as substantially shown in FIGS. 1A and 1B, though different arrangements of the holes may be provided. The holes 12 are used for attaching other component elements to be described below in greater detail. Also, about the outer circumference of the annular surface 10′ are four hollow projecting sleeves 14, preferably spaced 90 degrees apart about the circumference. The ends of the four sleeves 14 remote from the circumference of the annular surface 10′ are provided with interior threads serving as female connecting portions for other components to be described below in greater detail.

The engineering module 10 has a first open end 16 that is a reduced diameter projecting cylindrical portion having exteriorly-formed threads about its outer circumference to serve as a male connecting projection. The engineering module also has a second open end 18 which is provided with interiorly-formed threads for forming a female-connecting element. Thus, it is possible to connect a plurality of the engineering modules 10 together to form a linear array by screwing the first male end of each engineering module to a second female end of another engineering module. When a plurality of these engineering modules are thus connected together, they simulate the living and working spaces of a space station or space ship, while the sleeves 14 are meant to represent air locks for these living and working spaces.

Figure 2A:
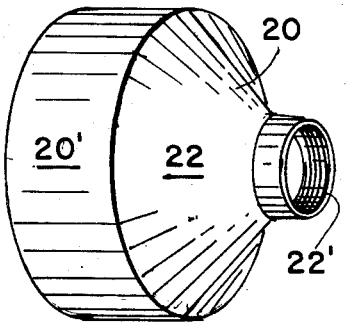
FIG. 2A is a perspective view showing one of the engineering module terminators forming a sub-series used to close off those free ends of the engineering modules of FIG. 1A connected together in a linear array that are not connected to another engineering module to define the end limits of each linear array of engineering modules.
Figure 2B:
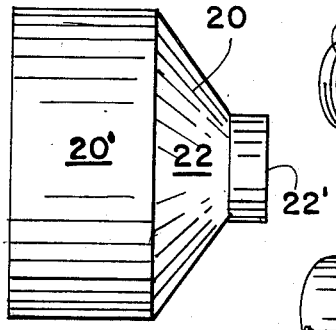
FIG. 2B is a side view of the engineering module terminator of FIG. 2A.

When having arranged a linear array of these engineering modules 10, it is sightly to have the exposed, unattached ends of the last modules closed off or terminated. To this end, a plurality of engineering module terminator components 20 are provided, one of which is shown in FIGS. 2A and 2B. The engineering module terminator component 20 has a main hollow ring-shaped portion 20′ having an open end with interiorly-formed threads to serve as a female mounting acceptor for mounting to the male end 16 of a last one of the engineering modules of a linear array. Each terminator 20 is also provided with a hood or truncated conical portion 22 having a connecting sleeve 22′ projecting from its truncated end (as shown in FIGS. 2A and 2B). The sleeve 22 is also interiorly-threaded to act as a female connector, so that the entire linear array may be connected at its end to other components described below.

Figure 1C:
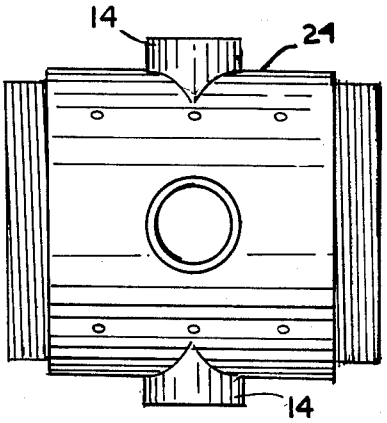

It is pointed out that since each of the engineering modules 10 has one male end and one female end, it will occur at one end of each linear array that a female end 18 is left unattached, which female end 18 still needs to be terminated by a terminator 20. Therefore, a plurality of end engineering modules are provided, one of which is shown in FIG. 1C. This end engineering module 24, instead of having one female connecting end and one male connecting end, is provided with two male connecting ends, as shown, so that the unattached male connecting end may be screw-connected to a terminator 20 via a terminator's female connecting end.

In one form of the present invention, each engineering module may have an outer diameter of 4 inches, while each air lock or sleeve 14 has an outer diameter of $\frac{3}{4}$ inches. The main cylindrical portion 20′ of the terminator 20 preferably has an outer diameter of 4 inches also, so that the slightly reduced male connecting ends of the engineering modules will screw therein. The sleeve 22′ of the terminator is also $\frac{3}{4}$ of an inch in outer diameter.

The length of each engineering module from end to end may vary from 1 to 3 inches. It is, of course, to be understood that the dimensions stated above and all dimensions stated hereinafter are given only for reference purposes and do not in any way constitute a limitation of the present invention. The dimensions may be changed to fit the requirements and needs of one skilled in the art.

Second Component Series—Connecting Tube Components

Figure 3:
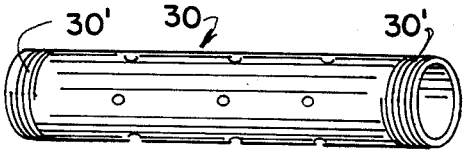
FIG. 3 is a perspective view showing one of the connecting tube components constituting the second major component series of the present invention.

The second major component series are a plurality of connecting tubes, one of which is shown in FIG. 3. The connecting tube 30 is generally an elongated hollow cylindrical element having exteriorly-threaded ends 30' to form male connecting ends. The surface of the connecting tube 30 is provided with a plurality of holes, preferably in the same manner as formed in each engineering module, so that there are four groups of three holes spaced 90 degrees apart about the circumference of the connecting tube, as shown in FIG. 3.

The connecting tubes 30 generally are provided in two different diametric sizes: small diameter and large diameter sizes. The small-diameter connecting tubes 30 generally constitute the staple connecting tubes since they are connectable to the sleeves or air locks 14 of the engineering modules. Thus, in one example of the invention, the outer diameter of these small-diameter connecting tubes is ½ inch to screw inside the female connecting end of a sleeve 14. These small-diameter connecting tubes 30 also connect to the sleeves 22' of the engineering module terminators 20, so that linear arrays of engineering modules may be connected together via these small-diameter connecting tubes. The linear arrays of engineering modules 10 may be connected together so that the arrays are parallel to each other or at an angle to each other, which is described in greater detail below.

The large diameter connecting tubes are, in the preferred form of the invention, used in special situations where a large-diameter tube is desired for special effects or design. A special coupling member, called a transition coupling step-up component, is provided to allow connection of the large-diameter connecting tube to the small-diameter connecting tube or to the sleeves 14 or to the sleeves 22', which step-up member will be described in greater detail below when discussing the third major component series.

The length of each of the connecting tubes depends upon the diameter. Thus, for the large-diameter connecting tubes, the length of the tube may typically be 6 inches with an outer diameter of the tube being 1½ inches, while for the small-diameter connecting tube, the length thereof may be only 3 inches, with an outer diameter of only ½ inch. A shorter version of the small-diameter connecting tube is also provided, so that it has a total length of only 1 inch with an outer diameter of ½ inch. These shortened versions of the small-diameter connecting tubes are used for cross-attaching engineering modules via respective sleeves or air locks 14 of the engineering modules. These shortened versions allow for closer attachment of the linear arrays of engineering modules 10 together, whereas the longer versions of the small diameter connecting tubes allow for greater distancing of the linear arrays.

The holes provided in the surface of each connecting tube also serve to allow attachment thereto of other component parts previously described and to be described below.

Third Component Series—Transition Coupling Elements

Figure 4A:
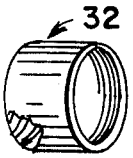
FIGS. 4A through 4E show the various forms of the transition coupling elements constituting the third major component series of the present invention.

The third component series are what are termed the "transition coupling elements," which are utilized to connect together the adjacent ends of connecting tube components, to provide a chain of such connecting tube components. These transition coupling elements are shown in FIGS. 4A through 4E. In FIG. 4A, one of a number of straight coupling elements 32 is shown, which, as shown, is a hollow cylindrical sleeve member having interiorly-threaded ends to form female attaching parts for attachment to the male connecting ends of the connecting tube components. Use of the straight coupling elements 32 provides a linear, coextensive extension of connecting tube components.

Figure 4B:
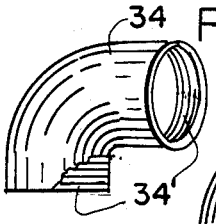

One of another type of transition coupling elements is shown in FIG. 4B, and is a right-angle coupling element 34 having its respective interiorly-threaded open ends 34' oriented at a right angle to each other, so that two connecting tube components 30 may be connected perpendicular to each other.

Figure 4C:
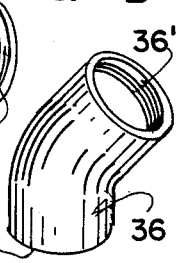

One of still another type of transition coupling elements is shown in FIG. 4C, and is a 45-degree angle element 36 where its interiorly-threaded open ends 36' are oriented at a 45 degree angle to each other for connecting two components 30 at a 45 degree angle.

Figure 4E:
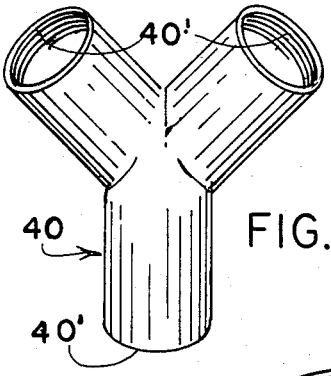
Figure 4D:
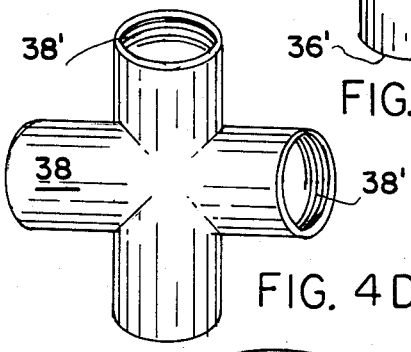

One of still another type of transition coupling elements is shown in FIG. 4D, and is an "X"-junction coupling element 38. In this coupling element, each of the four interiorly-threaded open ends 38' is at a right angle to two adjacent open ends and faces oppositely to its distal end. This transition coupling elements 38 is used to connect four connecting tube components 30 together with each being perpendicular to adjacent ones.

FIG. 4E shows still another type of transition coupling elements 40 which is a "Y"-junction coupling element, where its interiorly-threaded open ends 40' are spaced 120 degrees apart to form a "Y" shape.

Each of the above-described transition coupling elements comes in two different diameter sizes, a small one to connect small-diameter connecting tubes, and a large one to connect large-diameter connecting tube components. In one form of the invention, when the small and large connecting tube components have outer diameters of ½ and 1½ inches, respectively, the outer diameters of each of the interiorly-threaded open ends of transition coupling elements will be ¾ of an inch and 1¾ inches, for the small and large transition coupling elements, respectively.

Figure 7A:
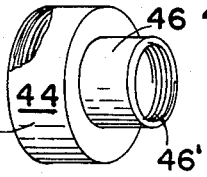
FIG. 7A is a perspective view of one of the transition coupling step-up elements constituting another sub-series of the transition coupling elements which are used to connect connecting tube components of different diameters.
Figure 7B:
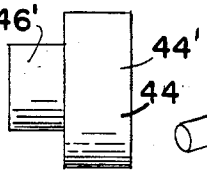
FIG. 7B is a side view of the transition coupling element step-up element of FIG. 7A.

An additional type of transition coupling elements is shown in FIGS. 7A and 7B, which is called a "step-up" transition coupling adapter, for this type is used to interconnect a small-diameter connecting tube component with a large-diameter connecting tube component as previously described. To this end, each "step-up" transition coupling adaptor 42 includes a large-diameter ring-shaped portion 44 with an interiorly threaded open end 44' for receiving an end of a large-diameter connecting tube component, and a smaller diameter ring-shaped portion 46 extending axially outwardly from the central portion of the larger diameter ring-shaped portion 44. The smaller diameter ring-shaped portion 46 has an interiorly-threaded open end 46' for receiving an end of a small-diameter connecting tube component, so that the small and large diameter connecting tubes may be interconnected. When the small and large diameter connecting tubes have outer diameters of ½ inches and 1½ inches, respectively, the open interiorly-threaded ends of the small and large ring-shaped portions have outer dimensions of $\frac{3}{4}$ of an inch and $1\frac{3}{4}$ inches, respectively.

Figure 6A:
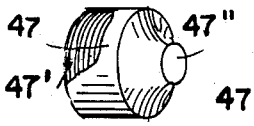
FIG. 6A is a perspective view of one of the connecting tube terminator components constituting a sub-series of the transition coupling elements.
Figure 6B:
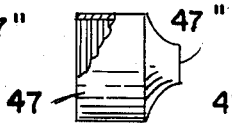
FIG. 6B is a side view of the connecting tube terminator component of FIG. 6A.

The last type of transition coupling elements is a "tube terminator," shown in FIGS. 6A and 6B. The tube terminator 47 shown is simply a ring having an open interiorly-threaded female connecting end 47' for closing off the end of the last connecting tube component in any series, to give a finished appearance. The other end of the terminator 47 is a truncated cone-shaped closed-off portion 47''. The terminator preferably comes in two sizes to match the two diametric sizes of the connecting tube components 34, as described above.

Figure 8:
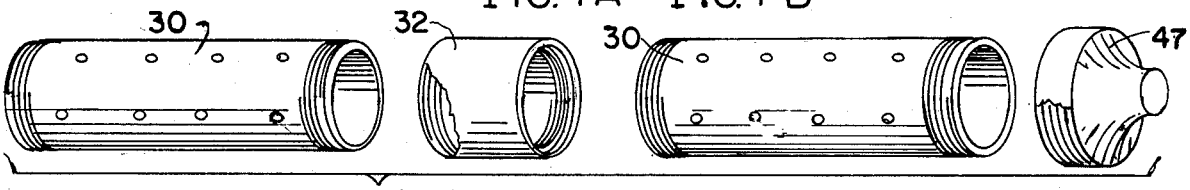
FIG. 8 is an exploded perspective view of the assembly of two connecting tube components with one intermediate linear transition coupling element between the connecting tube components and one connecting tube terminator component at a remote end of one of the connecting tube components.
Figure 10A:
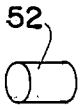
FIGS. 10A through 10E show the various forms of the rail coupling elements constituting the sixth major series of the present invention.
Figure 10B:
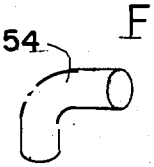
Figure 10C:
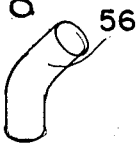
Figure 10D:
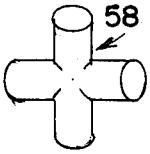
Figure 10E:
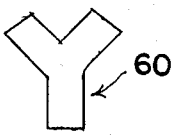

It can, therefore, be seen that the large and small connecting tube components 30 may be arranged in a multitude of arrays and designs by utilizing the transition coupling elements. Since each of the connecting tube components 30 and transition coupling elements is hollow, connections from the engineering modules, which simulate the interior working and living spaces of a space station or space ship, with the connecting tubes simulate the passageways or smaller working and living spaces of the space station or space ship. FIG. 8 shows the assembly of two small-diameter tube components via a straight transition coupling element 32, with an end of a tube being terminated with a terminator 47.

Fourth Component Series—Command Modules

Figure 5A:
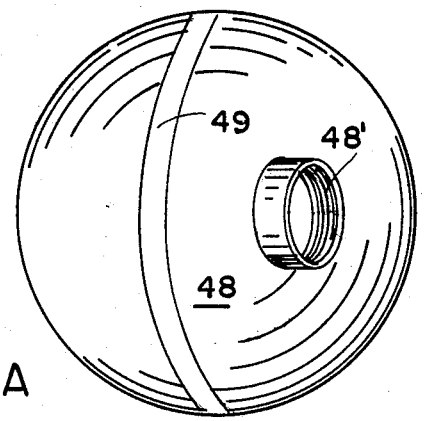
FIG. 5A is a perspective view showing one of the command modules constituting the fourth major component series of the present invention.
Figure 5B:
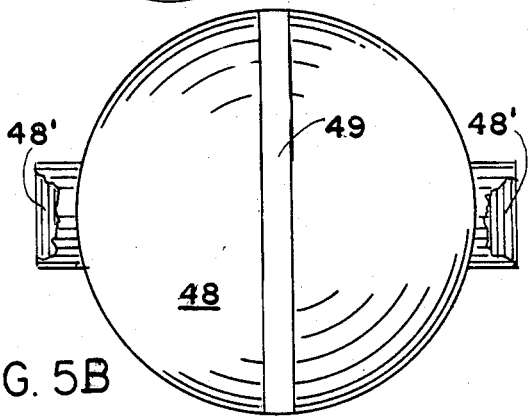
FIG. 5B is a side view of the command module of FIG. 5A.

FIGS. 5A and 5B show one of the fifth component series, which is a "command module." Each command module 48 is a hollow sphere or ellipsoid having at each end portion thereof a sleeve extension 48'. Each sleeve extension 48', which is similar to the sleeve 14 of the engineering module, has an interiorly-threaded open end for receiving therein an end of the small-diameter connecting tube component 30. The command module 48 is also provided with a circumferential rib 49 for special effect. The command module is designed to simulate a command module of a space station or space ship, where the controls are situated. In any design or sculpture of a space ship or space station, only one such command module will usually be employed, though, of course, more than one may be used. The outer diameter of the sleeve extension 48 is preferably $\frac{3}{4}$ of an inch, so as to receive therein an end of a small diameter connecting tube component 30.

Fifth Component Series—Rail Components

Figure 9:
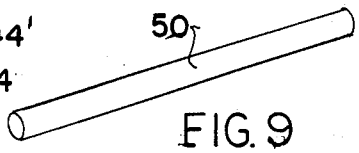
FIG. 9 is a perspective view showing one of the rail component members which constitute the fifth major component series of the present invention.

FIG. 9 shows one of the rail components 50, which is simply an elongated bar member which is typically 3 inches in length. The bar may be either hollow or solid, and is so dimensioned that either end thereof will fit into a hole of the connecting tube components 30 and the engineering modules 10. The rail components are meant to simulate lattice work structure of a space ship or space station extending from the connecting tubes and engineering modules.

Sixth Component Series—Rail Coupling Elements

The sixth major component series are a plurality of rail coupling elements used to interconnect the rail components to provide a chain of such rail components. The rail coupling elements come in basically the same shapes as the transition coupling elements. The rail coupling elements are shown in FIGS. 10A through 10E, and are, respectively, a straight connection 52, a right-angle connection 54, a 45-degree angle connection 56, an "X"-junction connection 58, and a "Y"-junction connection 60. Instead of the interiorly-threaded open ends of the transition coupling elements, the rail coupling elements simply have open ends in which the ends of the rail components are force-fitted. When the outer diameter of a rail component is $\frac{1}{8}$ of an inch, the outer diameter of an open end of each rail coupling element is approximately $\frac{1}{4}$ inch.

Supplementary Component Series

In addition to the above described six major component series, there are also provided a number of supplementary component series for simulating other actual features of a space station or space ship. In FIG. 11A, one of a number of tank storage components 62 is shown which has a shape of a tank for storing fuel or oxygen and the like. The tank 62 has a plurality of holes 62' in which are inserted an end of a tie stud or pin 64 shown in FIG. 13. Each of the studs or pins 64 preferably has an enlarged knob 64' at each end which pop into the holes provided on the engineering modules, the connecting tube components, and some of the supplementary components. Thus, to attach a storage tank component 62 to an engineering module 10 or to a connecting tube connector 30, the tie studs are inserted at their first ends in the holes 62' of the tank storage component with their second ends being inserted in the holes of the engineering module or connecting tube component or another storage tank component, etc. It is emphasized that the holes of each of the engineering modules and connecting tube components come in at least a series of three, as described above, so that supplementary components, as the tank storage component, may be supported thereon by a number of tie pins. Obviously, the spacing between the holes of the tank storage component is the same as the spacing between the holes of an engineering module and connecting tube component. These holes typically are $\frac{1}{8}$ inch-diameter holes. Tank storage component 62 may be ellipsoid-shaped or spherical, and the like.

Figure 11C:
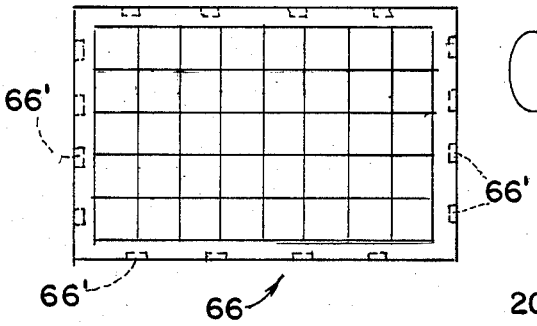
FIG. 11C is a frontal view showing one of the solar panel components also forming another part of the supplementary components.
Figure 11A:
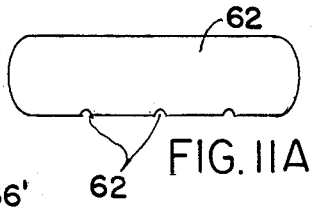
FIG. 11A is a side view showing one of the storage tank components which constitute part of the supplementary component series.
Figure 11B:
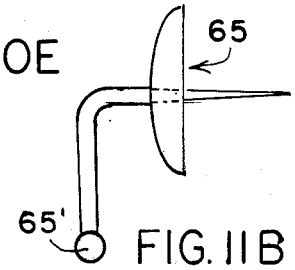
FIG. 11B is a side view showing one of the antenna components forming another part of the supplementary component series.

FIG. 11B shows another supplementary component, which is an antenna component 65. The antenna component, as shown in FIG. 11B, is shaped as an antenna, and has a knob 65' on the end of its support shaft to fit inside a hole on a connecting tube component 30 or an engineering module 10.

FIG. 11C shows still another supplementary component, which is a solar panel component, designed to look like a solar panel. The solar panel component 66 is provided with a series of holes 66' around the circumference thereof, so that the tie studs or pins 64 may be inserted at first ends thereof, while their second ends are inserted into holes on the engineering modules or connecting tube components, or other components. The solar panel may be oriented either length-wise or width-wise depending upon which holes 66' are used.

FIGS. 12A and 12B show supplementary components that are screwed onto small-diameter connecting tubes rather than being adjoined by the tie pins or studs 64. In FIG. 12A, one of a number of landing pod components 70 is shown which is designed to look like a landing pod or foot of a space craft, as on the lunar lander. In this component, the main pod-shaped portion 70' has an upstanding sleeve extension 70' with interior threads for screwing on to an end of a connecting tube component of small diameter. Typically, the outer diameter of the sleeve extension of the landing pod is $\frac{3}{4}$ of an inch, so as to receive therein the small $\frac{1}{2}$ inch connecting tube component.

FIG. 12B shows one of the number of engine components designed to resemble a rocket engine. The engine component 72 has a funnel-shaped main body portion 72' and a ring-shaped female mounting element 72'' having an interiorly-threaded open end remote from the funnel-shaped portion. The ring-shaped mounting element 72'' receives therein an end of a small diameter connecting tube component.

FIG. 14 shows one of the tether components 74, typically 12 inches in length, which has knobs 74' at its ends. The tether component 74 is a flexible element typically having ⅛ inch diameter end knobs 74'. The tether 74 may also have an interior flexible wire to increase flexibility. Each tether component knob fits into a hole formed in a portion of space man 76 shown in FIG. 16B, while the other end is force-fitted into a hole of one of the engineering modules 10, or connecting tube components 30, so as to simulate space walking.

FIG. 15 shows an air lock fitting component 80 which is designed to fit over an open or unused sleeve extension 14 of the engineering modules 10, or sleeve extension 48' at the command modules 48, or sleeve extension 22' of engineering module terminator 20. Each air lock fitting 80 has a screw-in portion 80' of the same dimension as a small diameter connecting tube component 30 for screwing into the female connections end of a sleeve 14. A flap 82 is also provided and is hinged to the screw-in portion 80' by a tab 82'. The flap 82 is for access to or closing off a sleeve 14 which simulates an air lock of a space ship or space station.

FIG. 16A shows still another supplementary component, which is a heat radiator component 84. The heat radiator component 84 is provided with a series of holes 84' formed about its circumference for attachment by the tie studs or pins 64, in the same manner as the solar panel component 66.

FIGS. 17 and 18 show examples of the different types of designs that may be produced with the knockdown toy of the present invention. FIG. 17 shows a space ship design, while FIG. 18 shows a space station design. In FIG. 17, it is clearly shown how the engineering modules 10 are connected together in a linear array, with each linear array being connectable to another linear array via connecting tube components 30. Since the design of FIG. 17 is a space ship, a command module 48 is shown at the head of the design, connected to the central linear array of engineering modules 10 via connecting tube components 30. Storage tank components 62 are provided, as well as a modification of the storage tank components: The spherical storage tanks 63 mounted adjacent the engine components 72 at the rear of the two outer linear arrays of engineering modules. Heat radiator component 84 is also shown attached to connecting tube components 30 between two linear arays of engineering modules. Antenna component 65 is also shown attached to a connecting tube component 30. Further, there is shown a space walking space man 76 held to the space ship via tether component 74, which is plugged into a hole of an engineering module 10' at one end. Though not shown in the drawing, each of the unattached sleeves 14 of the engineering modules and the sleeve 48' of the command module 48, and the sleeve 22' of the engineering module terminators 20, is closed of by an air lock fitting 80. Each of the supplementary components 62, 63, and 84 are attached to the space ship by tie studs 64.

In FIG. 18, a space station is shown. In this design, which approximates the design of NASA's planned space station, there are 5 sets of engineering module linear arrays. In this design, the three arrays indicated by reference numerals 90 are attached to the array indicated by reference numeral 90' via short versions of the small-diameter connecting tube components 30 indicated by reference numerals 91. The Figure also shows the use of the "X"-junction transition coupling element 38 and "X"-junction rail coupling element 58. Forty-five degree angle rail coupling element 56 is also shown connected to a pair of rail elements 50. Further, in the central linear array of engineering modules indicated by reference numeral 90', there may be provided a pair of connecting tube components 30 connected atop the engineering module terminators 20, which connecting tube components are attached to the engineering module terminators by a screwing connection.

While FIGS. 17 and 18 do not show all of the components parts described above, any of components described herein may be used in any arrangement designed by a user of the present invention. The end design or sculpture may simulate an actual space vehicle, as, for example, FIG. 18, which resembles the actual space station envisioned by NASA scientists, or it may simulate any fanciful design imagined.

The designs of FIGS. 17 and 18 are shown only by way of example, and are not meant to show the only designs possible when using the parts of the present invention. Clearly, an almost limitless number of different designs may be produced with the component parts of the present invention, with the only limiting factors being the imagination of the user and the number of component parts supplied.

Though particular dimensions have been set out in the above description of the various component parts of the present invention, it is to be understood that these have been stated only by way of example, and do not in any way limit the use of other-sized and other-dimensioned component parts. Further, while the connections have been shown to be of the male-female type for the engineering modules 10 and connecting tube components 30, as well as other components parts, it is to be understood that other equivalent mounting attachment or connections may be employed instead. Further, while it has been shown that each engineering module 10 has identical construction, except for an end engineering module, it is part of the present invention to provide half of the engineering modules only with male attaching ends and half with female attaching ends.

All of the parts of the present invention are preferably made of transparent plastic formed by injection molding or other equivalent processes, although other materials such as wood or cardboard can be used. Further, while there have been shown five different coupling elements, it is to be understood that other differently-shaped and configured rail coupling and transition coupling elements may be utilized, such as octagonal and the like.

The component series may also be color coded, so that each component series has a different color, or so components in each component series come in different colors. For example, the connecting tube components 30 may come in one color for the large-diameter tubes, another color for the small-diameter longer tubes, and still another color for the small-diameter shorter tubes.

Each component may further be identified by a decal fixable on the component, which decal has specially-written information thereon to describe the component and which may give any technical information thereon in order to simulate the kind of information carried by a real NASA component.

Each finished sculpture or design may be hung from a ceiling, and the like, for display. Further, it is within the scope of the present invention to provide miniature furniture component pieces for insertion into the hollow components to simulate a real space station's living conditions.

A complete toy set made up of the component parts described above will typically have the following number of component parts:

| COMPONENT PART | NUMBER |
|---|---|
| Engineering Modules (10) | 20 |
| Terminal Engineering Modules (24) | 10 |
| Engineering Module Terminators (20) | 10 |
| Connecting Tube Components (30) | |
| Small diameter (long) | 30 |
| Small diameter (short) | 10 |
| Large diameter | 10 |
| Command Modules (48) | 5 |
| Transition Coupling Elements | |
| Straight (32) | 20 |
| Right-angle (34) | 10 |
| 45-degree angle (36) | 10 |
| "X"-junction (38) | 10 |
| "Y"-junction (40) | 5 |
| Step-up Adaptor (44) | 5 |
| Connecting Tube Terminators (47) | 10 |
| Storage Tank Components | |
| Ellipsoid (62) | 10 |
| Spherical (63) | 5 |
| Rail Components (50) | 30 |
| Rail Coupling Elements | |
| Straight (52) | 20 |
| Right-angle (54) | 20 |
| 45-degree angle (56) | 10 |
| "X"-junction (58) | 10 |
| "Y"-junction (60) | 5 |
| Antenna Components (65) | 5 |
| Landing Pod Components (70) | 10 |
| Air-lock Fitting Components (80) | 60 |
| Heat Radiator Components (84) | 10 |
| Tie Pins or Studs (64) | 100 |
| Space Men (76) | 10 |
| Tether Components (74) | 10 |
| Engine Components (72) | 8 |
| Solar Panel Components (66) | 2 |

While a specific embodiment has been shown and described, it is to be understood that numerous changes and modifications may be made without departing from the scope and spirit of the invention as set out in the appended claims.

What is claimed is:

1. A knockdown toy that is capable of being assembled into a variety of shapes and configurations resembling a space ship or space station comprising, in combination:

a plurality of similarly-shaped and similarly-sized engineering modules, each said engineering module having a diameter and a substantially three-dimensional configuration and comprising a first end and a second end, each of said first and second ends comprising means for attaching said respective end to an adjacent end of another one of said engineering modules; said plurality of engineering modules being capable of being combined in a series such that they are aligned end to end where each said engineering module is directly connected to another engineering module through respective adjacent ends thereof; each of said engineering modules further comprising at least one hole formed along at least a portion of the circumference thereof in which may be received a rod or the like; and at least one hollow projecting sleeve portion extending outwardly from a portion of the outer-circumferential portion of each of said engineering modules, said at least one hollow projecting sleeve portion simulating an air lock of a space station, and being connectable to another toy component, and having an interior end portion spaced from said portion of the outer circumference;

at least one storage tank component designed to simulate a fuel storage tank or oxygen storage tank, said at least one storage tank component comprising a main body having at least one hole formed at a portion of the outer circumference of said main body portion; and further comprising a plurality of insertion pins for connecting said at least one tank into said at least one hole formed along at least a portion of the circumference of each of said engineering modules.

2. A knockdown toy having a number of differently-shaped and configured components that when assembled simulate a space station or space ship, which toy may be taken apart and reassembled to depict differently designed space ships or space stations comprising, in combination:

a plurality of similarly shaped connecting tube components, each of said connecting tube components comprising an elongated main body portion and having a first end and a second end;

a plurality of transition coupling component members, each having generally a main body portion, each of said transition coupling component members having a first end and a second end, each of said first and second ends of each of said transition coupling component members being mountable to each of said first and second ends of each of said connecting tube components, so that a plurality of said connecting tube components may be connected together in a desired pattern;

a plurality of engineering modules of identical shape and configuration, each of said plurality of engineering modules having a generally hollow, elongated, cylindrical shape with a first connecting end and a second connecting end so that a plurality of said engineering modules may be interconnected by inserting the second end of one engineering module into the first end of another engineering module, to thus arrange a plurality of said engineering modules in a linear array where the aligned hollow interiors of said engineering modules simulate the interior living and working spaces of a space station or space ship; each of said engineering modules further comprising at least one circumferentially-mounted hollow projecting sleeve member into which is insertable one of said first and second ends of one of said plurality of connecting tube components, so that various arrangements of space ships and space stations may be configured;

each of said plurality of connecting tube components and each of said plurality of engineering modules comprising a plurality of holes formed along portions of the circumference thereof; and further comprising insertion members for insertion into a desired one of said holes formed in said engineering modules and said plurality of connecting tube components; each of said insertion members having a first end for fitting into a respective hole and a second end for insertion into another hole; and a plurality of differently-shaped facsimile elements designed to represent a component of a space ship or space station, each of at least some of said differently-shaped facsimile elements having a plurality of holes formed in its circumference so that a second end of one of said insertion members may be fitted therein, so that said differently-shaped facsimile elements may be attached to desired ones of said connecting tube components in any desired manner and combination.

3. The toy according to claim 2, further comprising at least one miniature space man component, and at least one tether component for connecting said at least one space man component to said connecting tube components, said at least one space man component having at least one hole for receiving therein one end of said at least one tether component, while the other end of said at least one tether component is attachable to a hole in one of said connecting tube components and engineering module so as to simulate a space-walking space man.

4. A knockdown toy that is capable of being assembled into a variety of shapes and configurations resembling a space ship or space station comprising, in combination:

a plurality of similarly-shaped and similarly-sized engineering modules, each said engineering module having a diameter and a substantially three-dimensional configuration and comprising a first end and a second end, each of said first and second ends comprising means for attaching said respective end to an adjacent end of another one of said engineering modules; said plurality of engineering modules being capable of being combined in a series such that they are aligned end to end where each said engineering module is directly connected to another engineering module through respective adjacent ends thereof; each of said engineering modules further comprising at least one hole formed along at least a portion of the circumference thereof in which may be received a rod or the like; and at least one hollow projecting sleeve portion extending outwardly from a portion of the outer-circumferential portion of each of said engineering modules, said at least one hollow projecting sleeve portion simulating an air lock of a space station, and being connectable to another toy component, and having an interior end portion spaced from said portion of the outer circumference;

at least one command module of substantially three-dimensional shape, said at least one command module having at least one connecting extension projecting from an end thereof, said connecting extension having a holow interior for reception therein of another toy component;

a plurality of separate and distinct connecting tube components, each of said plurality of connecting tube components having a substantially hollow cylindrical configuration of substantially smaller diameter than each of said plurality of engineering modules; each of said plurality of connecting tube componenets having a first exterior end and a second exterior end for connection into a chosen one of said hollow projections of said engineering modules and said at least one connecting extension of said command module, whereby said connecting tube components can connect linear arrays of engineering modules and also connect a linear engineering module array to said at least one command module;

each of said plurality of connecting tube components comprising at least one hole formed through a portion of its circumference; and further comprising a plurality of rail component members, each of said plurality of rail component members having an elongated shape, one end of each rail component member being insertable into a hole of one of said plurality of connecting tube components so that lattice work designs may be added upon the linear array of engineering modules and command module and connecting tube components attached thereto.

5. The toy according to claim 4, further comprising at least one antenna shaped component member having an antenna shape and a plug-in end for insertion into a hole of one of said plurality of engineering modules and said plurality of connecting tube components; each of said plurality of rail component members also being insertable into a hole of one of said plurality of engineering modules.

6. The toy according to claim 4, further comprising a plurality of rail coupling members for connecting one end of one rail member to an end of another rail member; each of said plurality of rail coupling members having a first open end for receiving therein in telescoping fashion an end of one of said plurality of rail component members, and a second open end spaced from said first open end for receiving therein, also in telescoping fashion, an end of another of said plurality of rail component members, so that said rail component members may be attached together.

7. The toy according to claim 6, wherein said plurality of rail coupling members comprise a first set of linear coupling members where each of said linear coupling members comprises an elongated tubular portion having said first open end and said second open end facing opposite to each but in linear alignment; a second set of right angle coupling members where said first open end is at right angles to said second open end; a third set of 45 degree angle coupling members where said first open end is oriented 45 degrees relative to said second open end; and a fourth set of coupling members where said first open end is in linear alignment with said second open end but facing oppositely to each other, and also comprising a third open end and a fourth open end at right angles to said first and second open ends but in linear alignment with each other; a fifth set of coupling members forming a "Y" configuration; and further comprising at least one landing pod component member having the shape of a landing pod, said at least one landing pod component member having a receiving portion in which an end of one of said connecting tube components is inserted.

* * * * *